United States Patent [19]

Lamb

[11] 4,161,970

[45] Jul. 24, 1979

[54] METHOD AND APPARATUS FOR FILLING DOWN GARMENTS

[76] Inventor: George D. Lamb, 802 S. Sherman St., Longmont, Colo. 80501

[21] Appl. No.: 877,169

[22] Filed: Feb. 13, 1978

Related U.S. Application Data

[62] Division of Ser. No. 810,523, Jun. 27, 1977, Pat. No. 4,094,126.

[51] Int. Cl.[2] ..... B65B 3/16

[52] U.S. Cl. ..... 141/114; 141/391; 222/327

[58] Field of Search ..... 222/405, 327; 141/391, 141/114, 390

[56] References Cited

U.S. PATENT DOCUMENTS

| | | | |
|---|---|---|---|
| 2,691,982 | 10/1954 | Jones | 222/327 |
| 3,367,560 | 2/1968 | Johnson | 141/10 |

*Primary Examiner*—Steven L. Stephan

*Attorney, Agent, or Firm*—Richard D. Law

[57] ABSTRACT

A tubular inserter/extractor and a packet of down. The packet includes a tubular, film package permanently sealed at one end, and at the opposite end has two elongated tabs extending beyond a releasable seal. The packet is placed in the tubular inserter/extractor and the two tabs are pulled backward along the extractor, after opening the packet by the releasable seal, to turn the packet inside-out and release the down contained in the packet.

3 Claims, 7 Drawing Figures

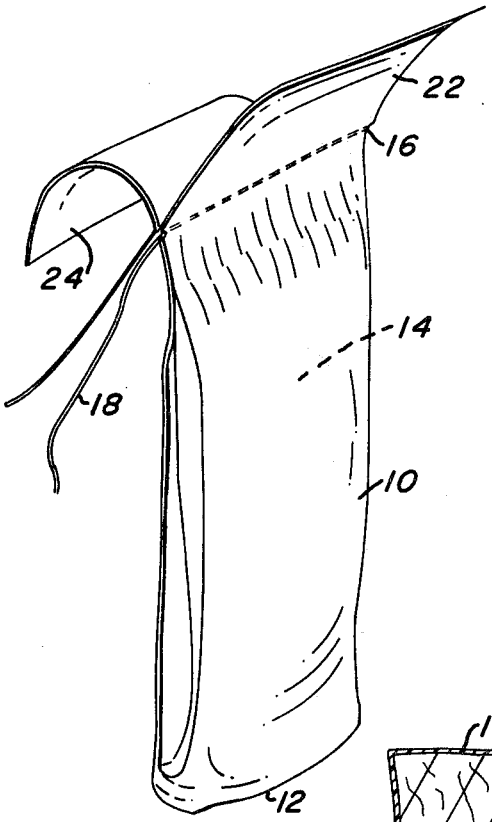
Fig.-1
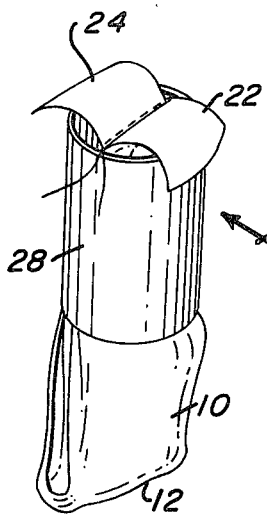
Fig.-3
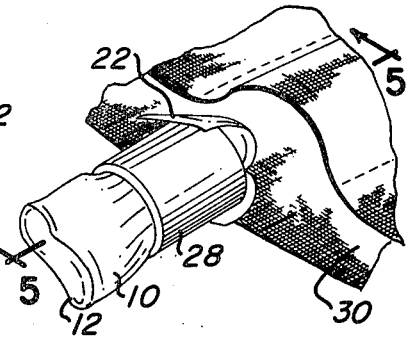
Fig.-4
Fig.-5
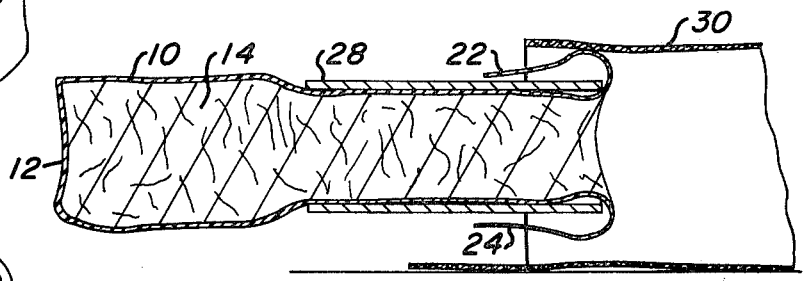
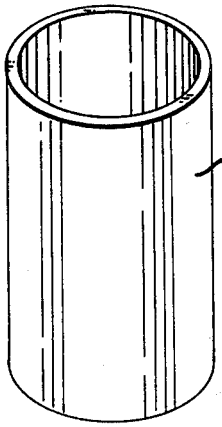
Fig.-2
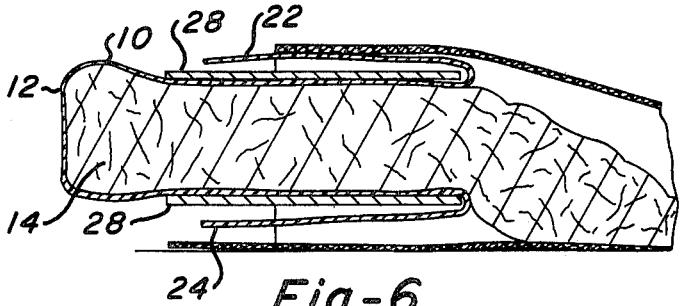
Fig.-6
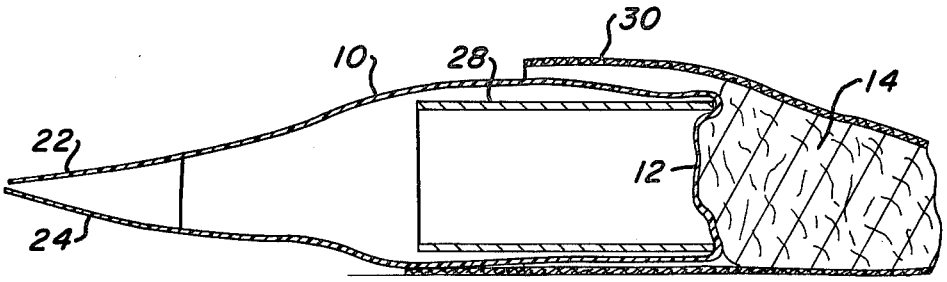
Fig.-7

METHOD AND APPARATUS FOR FILLING DOWN GARMENTS

This application is a divisional application of copending application Ser. No. 810,523, filed June 27, 1977 now U.S. Pat. No. 4,094,126 issued June 13, 1978.

PRIOR ART

Down-filled equipment, such as garments and sleeping units, have been used for a long time. Recently down-filled cold weather equipment has become very popular and a number of manufacturers specialize in this type of equipment. The cost of such equipment has skyrocketed due to the hand labor required, and, therefore, is a deterrent to more extended use to such type of equipment. A recent innovation has been the production of kits for do-it-yourself fans. These kits contain the elements of a particular structure, i.e., the cloth elements which are pre-cut and are to be stitched together in the shape of the garment, leaving compartments for the down. Fluffed up down is a very light material, where a single ounce of good quality down may occupy up to about 500 cubic inches of space. Thus, it is seen that while a small weight of down is used a large volume is necessary for the garments. The assembly of the elements in the kits from the manufacturer is relatively simple, requiring knowledge of a sewing machine, sometimes patterns and some knowledge of sewing techniques such as button holes, zippers, etc. A problem arises, however, in the placement of the down into the pockets in the garment. Recent innovations aid the user by providing the down in small packets containing a relatively precise weight of down which is arranged to go in a particular size pocket, rather than providing one container of down.

One attempt to aid the do-it-yourself garment maker is shown in U.S. Pat. No. 3,367,560 to Johnson, patented Feb. 6, 1968. In this disclosure, a quantity of down in a sheet plastic tube, is opened at one end. The open end is inserted into the compartment for the down, and the opposite end of the tubular packet is pushed inwardly to expel the contents of the bag. This however requires considerable skill and manipulation of the packet, holding it and the garment compartment while it is being turned inside-out (and it rarely is ever turned completely inside-out so that some of the feathers and down remain in the bag). Considerable difficulty is encountered in attempting to maintain the open end of the packet in the compartment while the bag is being turned inside-out.

THE INVENTION

According to the teachings of the present invention, "down" may be dispensed into compartments in garments without the difficulties found in the prior art. The invention includes an essentially rigid, tubular inserter-/extractor which is used to turn a tubular packet of down inside-out as it is pulled back around the tube, with the tube being inserted in a garment compartment. The inserter/extractor holds the down packet fully open when its end is in the down compartment in the garment. In this manner, the tubular packet may be turned inside-out at full diameter so that all of the down in the tubular packet is extracted from the tube. The tubular inserter/extractor being of relatively rigid material holds the garment compartment open to receive the down as it is discharged from the packet. The tubular packet is formed of flexible plastic film with a pair of manipulating tabs extending beyond an openable seal for the packet.

OBJECTS OF THE INVENTION

Included among the objects and advantages of the present invention is to provide apparatus for inserting down into compartments of a down garment, and a method of inserting the down from a tubular packet into such a compartment.

Another object of the invention is to provide an inexpensive method and apparatus for filling a compartment of a garment with down from individual packets of down.

Still another object of the invention is to provide an inserter/extractor device for down from a plastic film, tubular packet which is arranged to hold a garment compartment open while the packet is turned inside-out around the tube discharging all of the down from the packet a substantial distance into the compartment.

An additional object of the invention is to provide an inserter/extractor for down, and a packet for such down to be used in conjunction with the inserter/extractor for extracting down from the packet into a garment compartment.

GENERAL DESCRIPTION OF DRAWINGS

These and other objects and advantages of the invention will be readily apparent from the following description and appended illustrations in which:

FIG. 1 is a perspective view of a down packet, according to the invention;

FIG. 2 is a perspective view of an extractor for a down packet, according to the invention;

FIG. 3 is a perspective view of a down packet assembled with an inserter/extractor, in a smaller detailed view;

FIG. 4 is a perspective view of the assembly of FIG. 3 inserted in a garment compartment for dispensing down therein;

FIG. 5 is a cross-sectional, schematic, side elevation (taken along lines 5—5 of FIG. 4) of the initial positioning of the packet and inserter/extractor ready for dispensing;

FIG. 6 is an equivalent view with the dispensing of the down partially completed; and FIG. 7 is a similar view of the final phase of dispensing the down.

SPECIFIC DESCRIPTION OF DRAWINGS

A packet for down, according to the invention, is preferably made from a thin, flexible plastic film, generally of from 0.5 to 10 mils. Since there is little pressure in the packet, the thinner films are satisfactory. Many types of film are available, and polyethylene, polyvinyls, etc. are but a few of the types which may be used.

The down packet, FIG. 1, includes a tubular body 10 having one end 12 sealed, as by heat, adhesive, or the like to form a permanent seal. A quantity of down 14 (shown only generally as a mass for clarity) is filled in the tubular packet. The end 16 is sealed with a releasable seal, as by a thread 18 sewn so as to be easily removed for opening the packet. The size of the packet may be such as to hold a specific weight of down, as 1/16 oz, ⅛ oz, etc., as needed to fill specific sizes of compartments in the equipment. A manufacturer of kits will provide the necessary number of packets, each filled (and marked if necessary) with the necessary quantity of down for particular garment compartments. Each packet is temporarily sealed. However, the garment maker—from the kit, can, also, fill an open packet from a bulk supply for dispensing the same in a compartment. In this manner a single packet may be used for filling most or all of the compartments in a garment.

The packet 10 has a pair of extending tabs 22 and 24 which extend beyond the seal 16. These tabs may be integral with the packet 10 or may be tabs attached to the packet. When integral, the tube which forms the packet may be split on opposites to form the tabs. These tabs must be long enough to permit manually holding and pulling them, when the end of the packet is in a compartment. In a packet of some 4 inches in diameter and about 12 inches long, tabs of 3 to 5 inches are satisfactory.

An inserter/extractor tube 28, formed of cardboard or other light and essentially rigid material may be used in conjuction with the packet. The tubular inserter/extractor should be approximately the diameter of the down packet, or slightly smaller, to permit the packet to be pulled back over the exterior of the inserter/extractor, as explained below. The length of the compartment, and the length should permit easy handling. Since the down in the packet is fluffy and easily compressed, the down packet tube of about the same diameter as the inserter/extractor tube is easily inserted therein and pulled back over the inserter/extractor tube. The diameter of the inserter/extractor tube must, of course, be sized so as to be insertable in the garment down compartment.

For use of the device of the invention, a packet containing down is inserted into an inserter/extractor tube, as shown in FIG. 3. The tabs 22 and 24 are pulled back along the inserter/extractor tube, and the seal 16 is released. The open end of the packet is about at the end of the inserter/extractor tube. The inserter/extractor tube is then inserted into a down compartment 30 in a garment. The compartment has, of course, been formed by stitching along three sides of an area on two superposed garment covering materials. Once inserted in the compartment, the inserter/extractor tube holds the compartment open for receiving down, and holds the packet open at full diameter for extracting the down from the packet. The two tabs are then pulled back along the outside of the inserter/extractor tube. Pulling the tabs along the exterior of the inserter/extractor tube, turns the packet inside-out and pulls the packet tube back along the outside of the inserter/extractor tube, as shown in FIG. 6. This extracts the down from the packet and deposits the down into the garments compartment a considerable distance from the compartment opening. The down is released from the full diameter opening of the tubular packet. Further pulling of the tabs, turns the packet tube inside-out, FIG. 7, depositing all down in the pocket. The inserter/extractor tube and inside-out packet may now be withdrawn from the compartment opening stitched closed. The inserter/extractor may be withdrawn from the inside-out packet tube, ready for use with another down packet.

The extractor tube insures complete extraction of all down, from the packet, as the packet is turned completely inside-out. Also, by depositing the down into the garment compartment a distance from the compartment opening, very little down escapes during the filling and closing operation of each compartment.

The film for the down packet is usually sold as a tube and may be cut to desired length. One end is heat or adhesively sealed, and a slit on each side of the opposite end forms the flaps. Such film is flexible, crushable, pliant, limber, and soft. It may be made of many types of plastics (synthetic resins) presently available. The inserter/extractor tube is preferably of a uniform diameter along its length and is sufficiently rigid to retain its shape under the usage.

While the invention has been described with certain details and drawings, obvious modifications will be apparent, and these are intended to be included in the appended claims.

What is claimed is:

1. The combination of a packet of down and an inserter/extractor tube for dispensing down from the packet comprising:

(a) a flexible plastic film, tubular packet for down having one permanently sealed end and a releasable seal at the opposite end;

(b) a pair of manipulating flaps depending from opposed sides of said packet extending beyond said releasable seal; and, (c) an essentially rigid tube of approximately the diameter of said tubular packet and of a length of approximately ¼ to 1 length of said packet, whereby said tubular packet may be freely inserted in said rigid tube and said tubular packet may be easily pulled by said flaps from the inside back along the outside of the rigid tube so as to be turned inside out and dispense the down from the tubular packet.

2. The combination of claim 1, wherein said flaps are extensions of the material of said tubular packet.

3. The combination of claim 1, wherein said flaps are formed by slitting opposite sides of said tubular packet beyond the releasable seal.

* * * * *